US006024385A

United States Patent [19]

Goda

[11] Patent Number: 6,024,385

[45] Date of Patent: Feb. 15, 2000

[54] INFORMATIONAL DEVICE

[76] Inventor: Yukio Goda, 1699 Wall St., Suite 401, Mt. Prospect, Ill. 60056

[21] Appl. No.: 08/946,622

[22] Filed: Oct. 7, 1997

[51] Int. Cl.[7] ..... B42D 15/00

[52] U.S. Cl. ..... 283/61; 283/62; 283/56; 281/2; 281/3.1; 281/5; 281/9

[58] Field of Search ..... 283/61, 115, 62, 283/56; 402/79; 281/2, 9, 5, 3.1

[56] References Cited

U.S. PATENT DOCUMENTS

| | | | |
|---|---|---|---|
| 4,097,067 | 6/1978 | Schechter | 283/62 X |
| 4,583,763 | 4/1986 | Shacklett, Jr. | 283/62 |
| 4,643,452 | 2/1987 | Chang | 283/62 |
| 5,489,123 | 2/1996 | Roshkoff | 283/56 X |
| 5,572,815 | 11/1996 | Kovner | 402/79 X |

*Primary Examiner*—Willmon Fridie, Jr.
*Attorney, Agent, or Firm*—Wood, Phillips, VanSanten, Clark & Mortimer

[57] ABSTRACT

With a self adhesive base, the informational brochure can be affixed to direct mail, company literature, etc as well as to the back of a business card. An innovative piece designed with the intention of allowing the user to attach the informational brochure to the back of a standard size business card. This provides a very easy and flexible means of storing product or corporate information as well as keeping it organized without taking up much space. You simply peel off the adhesive label on the back of the informational device and attach it to any existing business card. The informational device folds down to a size of just 1⅞"×3⅜" and contains up to nine panels or individual pages of four color information.

19 Claims, 2 Drawing Sheets

INFORMATIONAL DEVICE

BACKGROUND OF THE INVENTION

1. Field of the Invention

This invention relates to the advertising field and, more particularly, to an informational brochure that can be attached to an object, such as a business card.

2. Background Art

In organizing a stack of business cards, it may be difficult to remember what business performed which service or sold which product. Brochures often take up so much space that it is impractical to keep them around for any great length of time. The inventor herein has noticed that many attendees of trade shows discard brochures that have been accumulated at booths, apparently due primarily to the inconvenience of having to carry bulky materials around.

SUMMARY OF THE INVENTION

In one form, the invention is directed to the combination of a) a business card and b) an informational brochure. The business card has first and second oppositely facing, substantially flat surfaces ad a perimeter edge bounding a first area. The first surface of the business card has business information thereon. The informational brochure has at least a first panel with first and second oppositely facing, substantially flat surfaces. The first panel is attached to the business card so as to be movable relative to the business card to selectively place the informational brochure in i) a folded state and ii) an unfolded state. The first panel resides within the perimeter edge of the business card with the first surface of the first panel facing the second surface of the business card with the informational brochure in the folded state. The first surface of the first panel is viewable with the informational brochure in the unfolded state. The first panel leaves substantially unobstructed the first surface of the business card with the informational brochure in the folded state.

In one form, the first panel has a perimeter edge bounding a second area that is not greater than the first area.

In one form, the perimeter edge of the business card defines a first shape and the perimeter edge of the first panel defines a second shape. The first shape is substantially the same as the second shape.

In one form, the informational brochure has a second panel having first and second oppositely facing, substantially flat surfaces, with the second panel being attached to the business card so as to be movable relative to the business card and the first panel as the informational brochure is changed between the folded and unfolded states. The second panel has a peripheral edge bounding a third area and the second and third areas together are larger than the first area.

In one form, the informational brochure has a third panel having first and second oppositely facing, substantially flat surfaces. The third panel is attached to the business card so as to be movable relative to the business card and the first and second panels as the informational brochure is changed between the folded and unfolded states. The third panel has a peripheral edge bounding a fourth area.

With the informational brochure in the folded state, the first panel overlies the second side of the business card and the second panel overlies the first panel so that the first and second panels have a combined perimeter edge that resides substantially within the perimeter edge of the business card.

The second panel may be joined to the first panel at a first fold line, with the first and second panels folding relative to each other about the first fold line as the informational brochure changes between the folded and unfolded states.

The informational brochure may have first and second flat covers which are movable relative to each other about a first fold line as the informational brochure changes between the folded and unfolded states. The first panel is movable relative to the first and second covers about a second fold line as the informational brochure is changed between the folded and unfolded states.

The first cover may be fixedly attached to the second side of the business card. The first and second covers may be releasably joined to each other at a location remote from the first and second fold lines.

In one form, the first and second covers each have a tab thereon and the tabs on the first and second covers are releasably joined by an adhesive.

In one form, with the informational brochure in the folded state, the first panel is captively located between the first and second covers.

In one form, the informational brochure has a second panel having first and second oppositely facing, substantially flat surfaces. The second panel is joined to the first panel so that the second panel is movable relative to the first panel about a fold line as the informational brochure is changed between the folded and unfolded states.

In one form, with the informational brochure in the folded state, the first and second panels are in overlying relationship with each other and captively located between the first and second covers.

In one form, the first and second covers and first and second panels each have a perimeter edge and with the informational brochure in the folded state, the first and second covers and first and second panels have a combined perimeter edge that resides substantially within the perimeter edge of the business card.

The informational brochure may have a third panel with first and second oppositely facing, substantially flat surfaces, with the third panel joined to the second panel so that the third panel is movable relative to the second panel about a fold line as the informational brochure is changed between the folded and unfolded states.

In one form, the business card and each of the first and second panels have a rectangular shape and with the informational brochure in the folded state, the first and second panels reside within the perimeter edge of the business card.

Information may be provided on a plurality of the oppositely facing flat surfaces of the first and second panels related to the business information on the first side of the business card.

In one form, the invention is directed to the combination of a) a promotional object and b) an informational brochure. The promotional object has first and second oppositely facing flat sides and a perimeter edge bounding a first area. The first side of the promotional object has business information thereon. The informational brochure has at least a first panel with first and second oppositely facing, substantially flat surfaces. The first panel is attached to the promotional object so as to be movable relative to the promotional object to selectively place the informational brochure in i) a folded state and ii) an unfolded state.

In one form, the invention is directed to an informational brochure having first and second substantially flat covers, a first panel having first and second oppositely facing, substantially flat surfaces, and an adhesive on the first cover that allows the first cover to be attached to an object. The first and second covers and the first panel are movable relative to each other to place the informational brochure selectively in i) a folded state and ii) an unfolded state. The first panel is captively located between the first and second covers with the informational brochure in the folded state. Both of the first and second flat surfaces on the first panel are visible with the informational brochure in the unfolded state. A releasable adhesive is applied to one of the second cover and the first cover to releasably adhere the second cover to one of the first cover and an object to which the informational brochure is attached, to releasably maintain the first panel captively between the first and second covers with the informational brochure in the folded state.

DETAILED DESCRIPTION OF THE DRAWINGS

Figure 1:
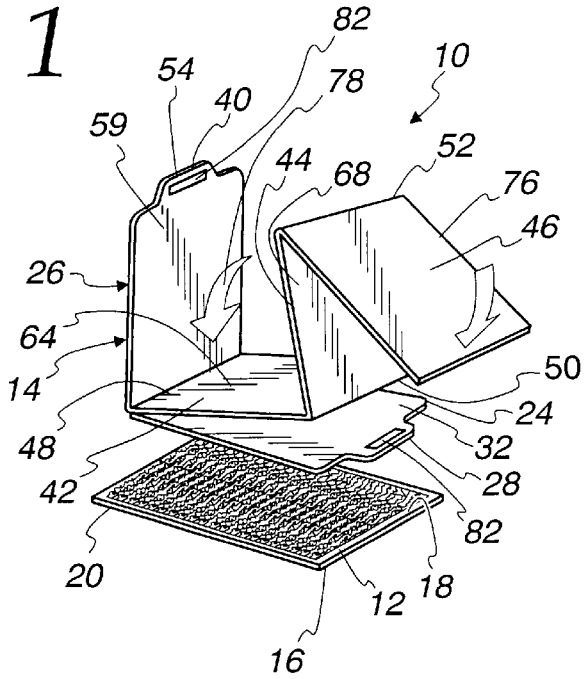
FIG. 1 is an exploded, perspective view of an informational device, according to the present invention, including a business card and an informational brochure, with the informational brochure shown in an unfolded state.

In FIGS. 1–7, one form of informational device, according to the present invention, is shown at 10. The informational device 10 consists of a conventional business card 12 to which an informational brochure at 14 is attached.

The business card 12 has a conventional rectangular shape with a width W on the order of 2 inches and a length L on the order of 3½ inches. The business card 12 has a flat shape with first and second oppositely facing, flat surfaces 16, 18 and a perimeter edge 20 which bounds a first area. The first surface 16 has business information, as shown at 22, placed thereon in a conventional format.

The informational brochure 14 consists of first and second subassemblies 24, 26 attachable to each other and to the business card 12. The first subassembly 24 is a flat cover with an overall rectangular shape and a projecting tab 28 thereon. The cover 24 has an overall length L1 on the order of 3⅜ projection lengthwise with respect to the cover 24 on the order of ¼ inch so that the length L2 of the cover 24, absent the length dimension for the tab 28, is on the order of 3⅛ inches. The cover 24 has a width W1 on the order of 1⅞ inch. Exemplary width W2 for the tab 28 is on the order of 1⅛ inch.

The cover 24 has oppositely facing, substantially flat, first and second surfaces 30, 32. The first flat surface 30 has an adhesive layer 34 applied thereto which allows the cover 24 to be adhered to the second business card surface 18 in such a manner that the perimeter edge 36 of the cover 24 resides substantially fully within the perimeter edge 20 of the business card 12.

The second surface 32 has an adhesive strip 38 applied thereto to bond the second subassembly 26 to the first subassembly/cover 24 and thereby to the business card 12.

The second subassembly 26 consists of a cover 40 and first, second and third panels 42, 44, 46, which are formed as one piece with each other and with the cover 40. The second subassembly 26 may be cut from a single sheet of flexible material. The second subassembly 26 has an overall length L3 on the order of 11 13/16 inch, with a width W3 on the order of 1⅞ inch.

Figure 2:
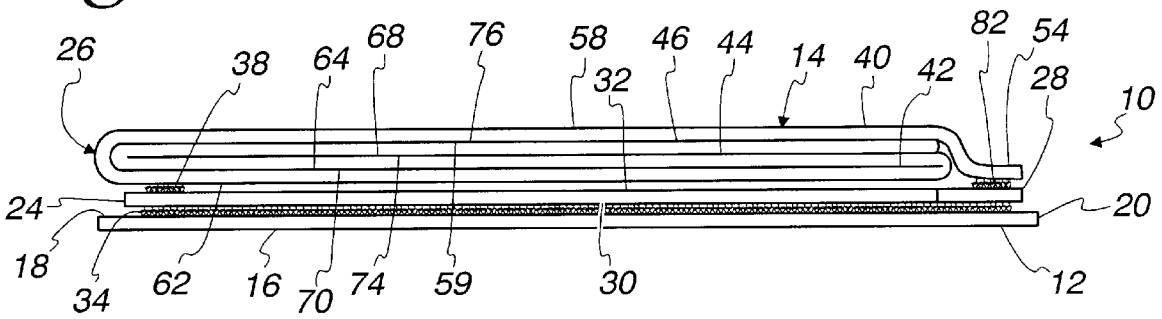
FIG. 2 is an enlarged, elevation view of the informational device in FIG. 1 assembled and with the informational brochure in a folded state.
Figure 3:
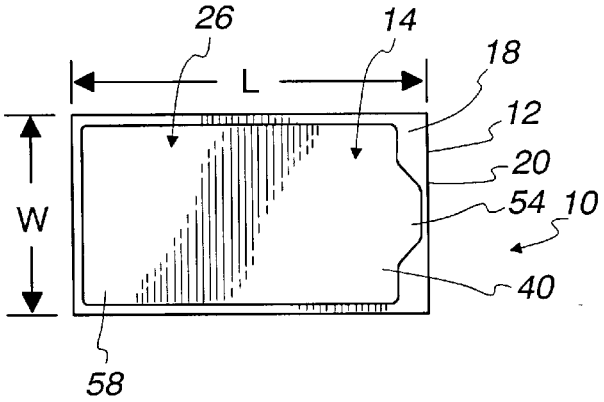
FIG. 3 is an enlarged, bottom view of the informational device in FIG. 1 with the informational brochure in a folded state.
Figure 4:
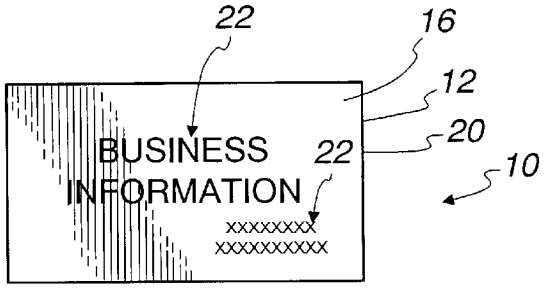
FIG. 4 is an enlarged, top view of the informational device in FIG. 1 with the informational brochure in a folded state.
Figure 7:
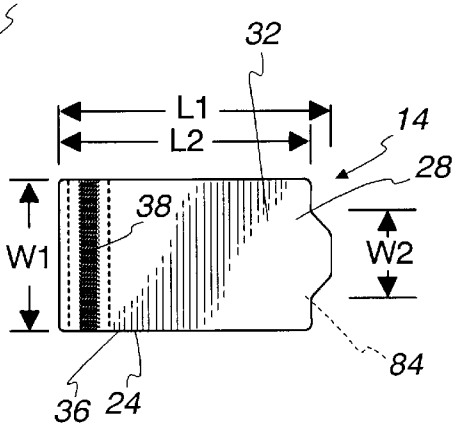
FIG. 7 is an enlarged, bottom view of a cover that is joined with the panels and cover in FIGS. 5 an 6 to define the inventive informational brochure.

A straight fold line 48 is defined between the cover 40 and first panel 42, with a similar fold line 50 being defined between the first panel 42 and second panel 44 and a fold line 52 defined between the second panel 44 and the third panel 46. The fold lines 48, 50, 52, are substantially parallel to each other and allow the covers 24, 40 and panels 42, 44, 46 to be moved relative to each other to allow the informational brochure 14 to be selectively placed in a folded state, as shown in FIGS. 2 and 3, and an unfolded/display state, as shown in FIG. 1.

The cover 40 has a lengthwise dimension L4 on the order of 3¼ inch. The first and second panels 42, 44 have a lengthwise dimension L5, L6, respectively, on the order of 2⅞ inch. The third panel 46 has a lengthwise dimension L7 on the order of 2 13/16 inch. The cover 40 has a projecting tab 54 thereon, having the same general configuration as the tab 28, with a lengthwise dimension L8 on the order of ¼ inch and a widthwise dimension W4 on the order of 1⅛ inch.

The cover 40 has a perimeter edge 56 and oppositely facing, substantially flat surfaces 58, 59. The first panel 42 has a perimeter edge 60 and oppositely facing, substantially flat surfaces 62, 64. The second panel 44 has a perimeter edge 66 and oppositely facing, substantially flat surfaces 68, 70. The third panel 46 has a perimeter edge 72 and oppositely facing, substantially flat surfaces 74, 76.

The adhesive strip 38 bonds between the surface 62 of the first panel 42 and the surface 32 of the cover 24. With this arrangement, the informational brochure 14 can be placed in the unfolded/display state to provide nine separate surfaces: 32 on the cover 24; 62, 64 on the first panel 42; 68, 70 on the second panel 44; 74 and 76 on the third panel 46; and 58, 59 on the cover 40.

In a preferred form, the information on the informational brochure 14 is correlated with the business information 22 on the business card 12. Accordingly, one can readily relate the surfaces and/or products described in the informational brochure 14 with the entity identified on the business card 12. The display area produced by the covers 24, 40 and panels 42, 44, 46 is substantially greater than the available area on the surfaces 16, 18 on the business card 12 alone.

At the same time, the informational brochure 14 can be changed from the unfolded/display state into the folded state in a simple manner, as described below, to compact into a size that preferably does not project substantially outwardly from the perimeter edge 20 of the business card 12. Starting from the stage shown in FIG. 1, the panel 44 can be moved around the fold line 50 in the direction of the arrow 78 to abut the panel surface 70 facially to the panel surface 64. The third panel 46 can be similarly moved relative to the fold line 52 to place a surface 74 thereon facially against the surface 68 of the panel 44. The first panel 42 can be pressed against the cover 24 after which the cover 40 can be moved around the fold line 52 to overlie the folded stack of panels 42, 44, 46.

An adhesive layer 82 is provided on one or both of the tabs 28, 54 to adhere the tabs 28, 54 releasably, each to the other. The panels 42, 44, 46 are dimensioned so that the tabs 28, 54 each extend lengthwise beyond the stack of panels 42, 44, 46 to allow them to be abutted, each to the other, as shown in FIG. 2. Through this arrangement, the cover 40 releasably captively maintains the panels 42, 44, 46 in stacked relationship and against the business card 12.

The informational brochure 14, in the folded state, leaves substantially unobstructed the first surface 16 of the business card 12. In a preferred form, the perimeter edges of the covers 24, 40 and panels 42, 44, 46 define rectangular shapes with areas slightly less than that of the first surface 16 of the business card 12 so that each display surface 32, 58, 59, 62, 64, 68, 70, 74, 76 provides a display area slightly less than the area of either of the business card surfaces 16, 18. In a folded state, the combined peripheral edge produced by the stacked panels 42, 44, 46 and covers 24, 40 is within the perimeter edge 20 of the business card 12.

Figure 8:
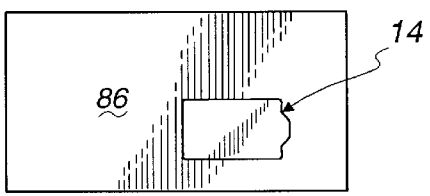
FIG. 8 is an elevation view of an object with an informational brochure, according to the present invention, attached thereto.
Figure 5:
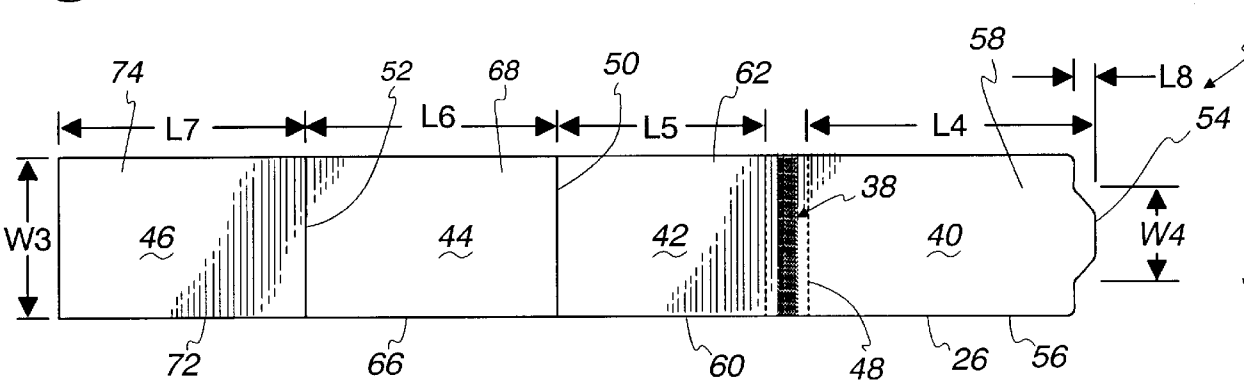
FIG. 5 is an enlarged, bottom view of three panels and a cover defining part of the inventive informational brochure.
Figure 6:
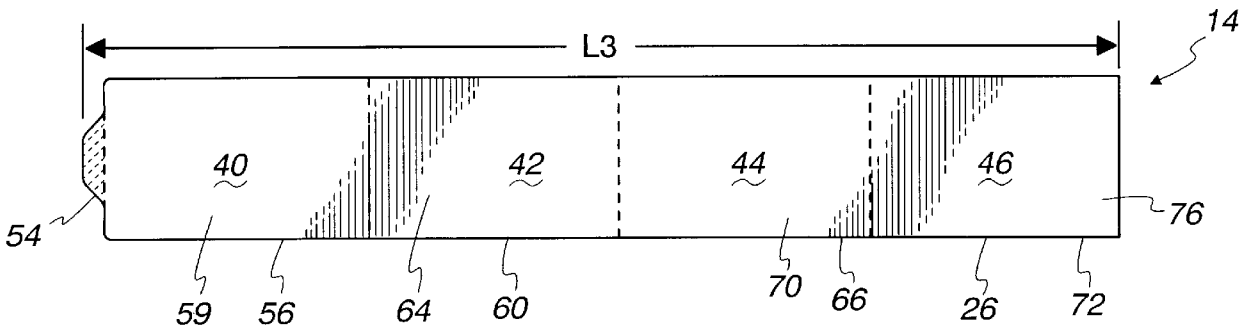
FIG. 6 is an enlarged, top view of three panels and a cover defining part of the inventive informational brochure.

As shown in FIG. 8, the informational brochure 14 can be attached to virtually any object, such as direct mail, company literature, etc.

With the invention, as described above, product and corporate information can be conveniently kept in association with a business card 12 without taking up an undue amount of space.

To facilitate attachment of the informational brochure 14, a protective layer 84 can be provided over the adhesive layer 34. By removing the layer 84 on site, the informational brochure 14 can be simply pressed onto an object 86 to which it is to be associated.

The adhesive layer 82, which connects between the tabs 28, 54, is preferably selected so that the tabs 28, 54 can be repeatedly separated and re-adhered to each other to allow access to the information on the informational brochure 14 as often as is desired.

The foregoing disclosure of specific embodiments is intended to be illustrative of the broad concepts comprehended by the invention.

The inventive informational device has printed piece that attaches to the back of a standard size business card using a self adhesive base. The informational device has nine individual pages that fold down into a size slightly smaller than an average business card. A typical use would be for the informational device to serve as a either a product or corporate information piece. A unique feature of the informational device is that it can be opened, closed and resealed via the adhesive strip as often as desired.

Two separate incidents served as inspiration for the invention of the Minilog.

1. After attempting one afternoon to organize a stack of business cards and trying desperately to remember what business performed which service or sold which product, the inventor thought it would be very useful to have product information in his file attached to each business card. Brochures simply take up too much space to keep around for any great length of time. The informational device seemed to be an easy and convenient means to both gather and store information.

2. Attending a trade show I noticed that a great deal of attendees were tossing away brochures that they picked up at booths. It seemed as the primary motivation for throwing the materials away seemed to be the sheer inconvenience of carrying the bulky materials around all day. The inventor thought to myself that if attendees could simply stick the product information in their pocket they would be more likely to keep it. Also, the invention thought that being able to keep the information with a business card it would be more helpful because they would be able to keep product information with the actual showsite name and contact phone number.

This in turn led to thinking about other instances where merging product information with a business card would be very useful.

POTENTIAL ADVANTAGES

1. Only product of it's kind (A nine page brochure) that actually attaches directly to the back of standard size business cards.

2. Ability to have multiple pages with the ability to carry a great deal of information yet fold down into a size slightly smaller than your average business card.

3. Can open, close and continually reseal the piece using the attached adhesive strip, so that if folds down neatly against the business card without sticking out or becoming too bulky.

4. Allows one to store product, corporate or service information in a space similarly used to store business cards (no additional storage or filling space required).

5. People are more likely to keep it as opposed to a brochure because of the sheet convenience and less wasted space.

6. Can open and close as many times as desired and re-sealed using the attached adhesive strip.

7. Flexible design capabilities allow the informational device to be creatively custom tailored to meet the individual needs of a customer.

8. Cost effective, less expensive than producing a standard sized corporate brochure.

9. Gives people the ability to keep product or corporate information at their fingertips or in their wallet or shirt pocket.

I claim:

1. In combination:

a) a business card having first and second oppositely facing, flat surfaces and a perimeter edge bounding a first area, the first surface of the business card having business information thereon; and b) an informational brochure comprising at least a first panel having first and second oppositely facing, substantially flat surfaces that is attached to the business card so as to be movable relative to the business card to selectively place the informational brochure in i) a folded state and ii) an infolded state, the first panel residing within the perimeter edge of the business card with the first surface of the first panel facing the second surface of the business card with the informational brochure in the folded state, the first surface of the first panel being viewable with the informational brochure in the unfolded state, the first panel leaving substantially unobstructed the first surface of the business card with the informational brochure in the folded state.

2. The combination according to claim 1 wherein the first panel has a perimeter edge bounding a second area that is not greater than the first area.

3. The combination according to claim 1 wherein the perimeter edge of the business card defines a first shape, the perimeter edge of the first panel defines a second shape, and the first shape is substantially the same as the second shape.

4. The combination according to claim 1 wherein the informational brochure comprises a second panel having first and second oppositely facing, substantially flat surfaces that is attached to the business card so as to be movable relative to the business card and the first panel as the informational brochure is changed between the folded and unfolded states, the second panel having a peripheral edge bounding a third area and the second and third areas together are larger than the first area.

5. The combination according to claim 4 wherein the informational brochure comprises a third panel having first and second oppositely facing, substantially flat surfaces that is attached to the business card so as to be movable relative to the business card and the first and second panels as the informational brochure is changed between the folded and unfolded states, the third panel having a peripheral edge bounding a fourth area.

6. The combination according to claim 4 wherein with the informational brochure in the folded state the first panel overlies the second side of the business card, and the second panel overlies the first panel so that the first and second panels have a combined perimeter edge that resides substantially within the perimeter edge of the business card.

7. The combination according to claim 6 wherein the second panel is joined to the first panel at a first fold line, the first and second panels folding relative to each other about the first fold line as the informational brochure is changed between the folded and unfolded states.

8. The combination according to claim 1 wherein the informational brochure comprises first and second flat covers which are movable relative to each other about a first fold line as the informational brochure is changed between the folded and unfolded states and the first panel is movable relative to the first and second covers about a second fold line as the informational brochure is changed between the folded and unfolded states.

9. The combination according to claim 8 wherein the first cover is fixedly attached to the second side of the business card.

10. The combination according to claim 9 wherein the first and second covers are releasably joined to each other at a location remote from the first and second fold lines.

11. The combination according to claim 10 wherein the first and second covers each have a tab thereon and the tabs on the first and second covers are releasably joined to each other by an adhesive.

12. The combination according to claim 1 wherein with the informational brochure in the folded state, the first panel is captively located between the first and second covers.

13. The combination according to claim 12 wherein the informational brochure comprises a second panel having first and second oppositely facing substantially flat surfaces, the second panel is joined to the first panel so that the second panel is movable relative to the first panel about a fold line as the informational brochure is changed between the folded and unfolded state.

14. The combination according to claim 13 wherein with the informational brochure in the folded state the first and second panels are in overlying relationship with each other and captively located between the first and second covers.

15. The combination according to claim 14 wherein the first and second covers and first and second panels each have a perimeter edge, and with the informational brochure in the folded state, the first and second covers and first and second panels have a combined perimeter edge that resides substantially within the perimeter edge of the business card.

16. The combination according to claim 13 wherein the informational brochure comprises a third panel having first and second oppositely facing, substantially flat surfaces, the third panel is joined to the second panel so that the third panel is movable relative to the second panel about a fold line as the informational brochure is changed between the folded and unfolded states.

17. The combination according to claim 13 wherein the business card has a rectangular shape, each of the first and second panels has a rectangular shape and with the informational brochure in the folded state, the first and second panels reside within the perimeter edge of the business card.

18. The combination according to claim 4 wherein there is information on a plurality of the oppositely facing, flat surfaces of the first and second panels related to the business information on the first side of the business card.

19. An informational brochure comprising:

first and second substantially flat covers; and a first panel having first and second oppositely facing, substantially flat surfaces;

an adhesive on the first cover that allows the first cover to be attached to an object, the first and second covers and first panel being movable relative to each other to place the informational brochure selectively in i) a folded and ii) an unfolded state, the first panel being captively located between the first and second covers with the informational brochure in the folded state, both of the first and second flat surfaces on the first panel being visible with the informational brochure in the unfolded state; and a releasable adhesive is applied to one of the second cover and the first cover to releasably adhere the second cover to one of the first cover and an object to which the informational brochure is attached to releasably maintain the first panel captively between the first and second covers with the informational brochure in the folded state.

* * * * *